US005272487A

United States Patent [19]

Pantsios

[11] Patent Number: 5,272,487

[45] Date of Patent: Dec. 21, 1993

[54] ELLIPTICALLY POLARIZED ANTENNA

[75] Inventor: Fred A. Pantsios, Quincy, Ill.

[73] Assignee: Harris Corporation, Melbourne, Fla.

[21] Appl. No.: 768,036

[22] Filed: Sep. 30, 1991

[51] Int. Cl.[5] ..... H01Q 13/12; H01Q 21/24

[52] U.S. Cl. ..... 343/727; 343/771; 343/891

[58] Field of Search ..... 343/770, 771, 725, 727, 343/890, 891, 729, 730

[56] References Cited

U.S. PATENT DOCUMENTS

| | | | |
|---|---|---|---|
| 4,839,663 | 6/1989 | Kurtz | 343/727 |
| 4,899,165 | 2/1990 | Schadler | 343/727 |
| 5,021,797 | 6/1991 | Dienes | 343/727 |
| 5,030,965 | 7/1991 | Park et al. | 343/727 |

*Primary Examiner*—Michael C. Wimer

*Attorney, Agent, or Firm*—Tarolli, Sundheim & Covell

[57] ABSTRACT

An elliptically polarized antenna is disclosed which includes a conductive mast having at least one elongated slot extending longitudinally of the mast at the outer periphery thereof and wherein energy is fed to the slot for exciting horizontally polarized waves. A pair of conductive elements are associated with each slot for exciting vertically polarized waves. This includes first and second elements each having a connecting end portion extending transversely from and connected to the mast near the midpoint of one elongated side of the slot with the element having a pair of free end portions extending in substantially opposing directions parallel to the slot. The free end portions have their respective lengths chosen relative to each other for purposes of controlling the split of the radiated energy between the horizontally and vertically polarized waves.

9 Claims, 7 Drawing Sheets

ELLIPTICALLY POLARIZED ANTENNA

FIELD OF THE INVENTION

This invention relates to the art of antennas and, more particularly, to antennas which take the form of an electrically conductive mast having at least one elongated slot extending longitudinally of the mast and which is employed for purposes of radiating horizontally polarized waves.

DESCRIPTION OF THE PRIOR ART

Antennas having such a slot are known in the art and one such example is disclosed in the U.S. Patent to S. J. Bazan U.S. Pat. No. 2,981,947. Antennas as described in that patent have been employed for providing horizontally polarized waves for television broadcasting. Such an antenna may take the form of a vertically aligned cylindrical mast having one or more slots cut in the wall of the cylinder and extending in a vertical direction. The mast may take the form of a wave guide which may be coaxial, rectangular or circular. The polarized energy radiated into space will be in a plane perpendicular to the elongated slot. Thus, if the slot is vertical the radiated energy will take the form of a horizontally polarized wave.

Attempts have been made to convert slotted antennas, such as that described in the Bazan patent, supra, so as to also enable the antennas to radiate circular polarized waves. Examples of such conversions include those described in the U.S. Patents to N. R. Johns U.S. Pat. No. 4,129,871 and J. L. Schadler U.S. Pat. No. 4,899,165.

The Johns patent discloses a circular polarized antenna including a conductive cylinder having an elongated slot. The slot is oriented vertically for purposes of achieving horizontally polarized radiation. A pair of monopoles extend from respective points closely adjacent each elongated side of the slot with the monopoles each having a free end portion which extends in the vertical plane for purposes of radiating vertically polarized waves.

The Schadler patent discloses a slotted antenna similar to that as disclosed in the Bazan patent but instead of an end fed monopole extending from the mast, it employs a pair of vertical elements and a horizontal element. This is a parasitic dipole.

Additional conversions of slotted antennas of the type disclosed in the Bazan patent, supra, are also described in my article "New Elements That Provide Pattern Versatility In Coax and Wavestar Antennas", IEEE Transactions on Broadcastings, Vol. 36, No. 3, September, 1990. That article describes slot excited monopoles positioned on either side of an elongated slot in a cylindrical mast. Each monopole takes the form of a straight radial section which extends from a point midway of the length of an elongated slot and from one side. The radial section extends radially outward from the mast to a right angle bend with a bent arm terminating in a free end. The free ends may extend in a horizontal direction relative to a vertically oriented slot or may extend vertically so as to be parallel to the direction of an elongated vertical slot. The former may be referred to as slot-excited horizontal L-shaped monopoles and the latter may be referred to as slot-excited vertical L-shaped monopoles. A variety of azimuthal horizontally polarized and vertically polarized patterns may be achieved with antennas constructed in accordance with my article.

The present invention is directed toward improvements over the prior art to achieve increased control of pattern shaping of the azimuthal horizontally polarized and vertically polarized patterns and for controlling the split of radiated energy between the horizontally polarized wave and the vertically polarized wave without disturbing the pattern shape.

SUMMARY OF THE INVENTION

It is therefore a primary object of the present invention to provide an elliptically polarized antenna having improved control over the split or division of energy radiated as horizontally polarized energy and vertically polarized energy and for controlling the shape of the vertical polarization pattern independently of the horizontally polarization pattern.

In accordance with the present invention, an elliptically polarized antenna is provided which includes a conductive mast having at least one elongated slot extending longitudinally of the mast at the outer periphery thereof and wherein energy is fed to the slot in such a manner for exciting horizontally polarized waves. A pair of conductive elements are associated with each slot for exciting vertically polarized waves. This includes first and second elements each having a connecting end portion extending transversely from and connected to the mast near the midpoint of one elongated side of the slot with the element having a pair of free end portions extending in substantially opposing directions parallel to the slot and wherein the free end portions have their respective lengths chosen relative to each other for purposes of controlling the split of the radiated energy between the horizontally and vertically polarized waves.

In accordance with a still further aspect of the present invention, the length of the free end portions are unequal with the difference in length controlling the magnitude of the vertically polarized wave.

Still further in accordance with the present invention, each of the conductive elements includes an intermediate portion which is located intermediate the connecting end portion and the pair of free end portions with the intermediate portion extending in a direction and being of a length chosen for purpose of controlling changes in the shape of the vertically polarized azimuthal pattern independently of those of the horizontally polarized azimuthal pattern.

BRIEF DESCRIPTION OF THE DRAWINGS

The foregoing and other objects and advantages of the invention will become more readily apparent from the following description of a preferred embodiment, as taken in conjunction with the accompanying drawings which are a part hereof, and wherein.

DESCRIPTION OF PREFERRED EMBODIMENTS

Figure 1:
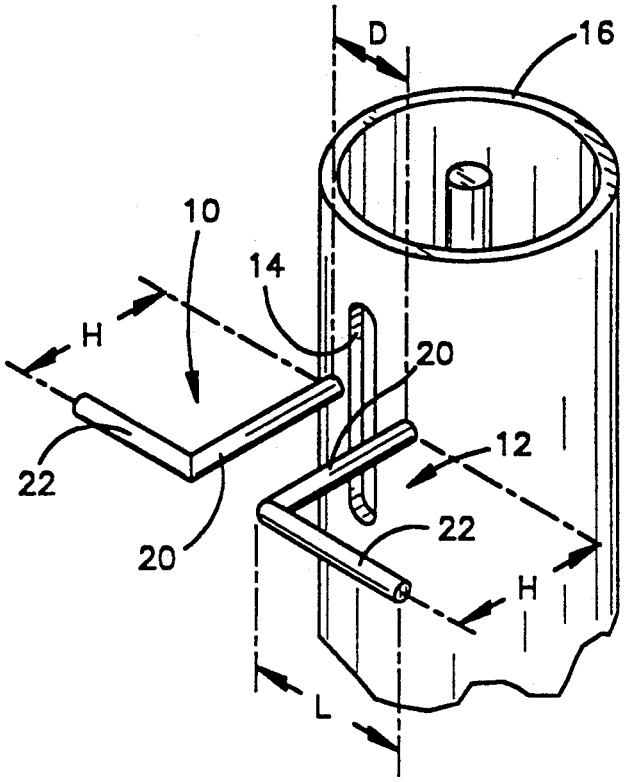
FIG.1 (PRIOR ART)
FIG. 1 is a perspective view of a prior art antenna system employing a pair of horizontally aligned L-shaped monopoles straddling a slot in a cylindrical mast.
Figure 2:
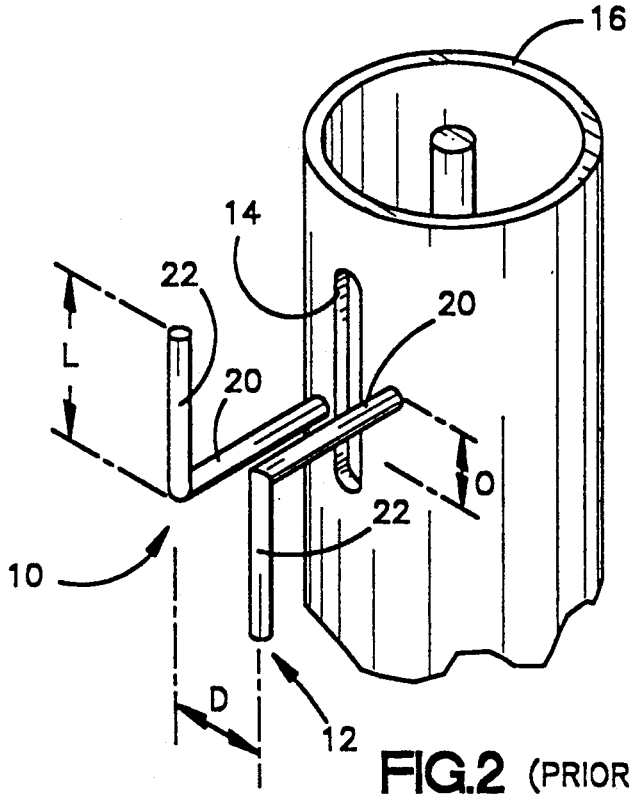
FIG.2 (PRIOR ART)
FIG. 2 is a perspective view similar to that of FIG. 1 but showing a pair of vertically aligned L-shaped monopoles.

Before describing the preferred embodiments, the invention is first directed to the prior art antenna system illustrated in FIGS. 1 and 2. FIG. 1 illustrates a pair of L-shaped horizontally oriented monopoles 10 and 12 which straddle an elongated vertically oriented slot 14 located in the peripheral wall of a cylindrical mast 16. The monopoles 10 and 12 each include a radially extending arm 20 which extends from the mast 16 and terminates in a 90° bend which then extends in a horizontal direction to define the free end arm portion 22. The arm portions 22 of monopoles 10 and 12 are symmetrical in that both of the free end arm portions extend in opposing horizontal directions.

The radially extending arms 20 of the two monopoles are located at the midpoint of the elongated slot 14 along opposing sides of the slot. The radially extending arms 20 have a length indicated by the dimension H and the arms 20 are spaced from each other dimension D. Each arm portion 22 is of a length as indicated by the dimension L. It has been found that varying the dimensions D, L and H will result in variations in the shape of the azimuthal pattern of the horizontally polarized wave radiated by this antenna.

Reference is now made to the prior art antenna system of FIG. 2 which illustrates a system similar to that as shown in FIG. 1 and, consequently, like components are identified with like character references. In FIG. 2, the monopoles 10 and 12 are rotated by 90° with the free end arm portion 22 of monopole 10 extending vertically upward, whereas the free end arm portion 22 of monopole 12 extends vertically downward. Moreover, the radially extending arm portions 20 of the respective monopoles 10 and 12 are vertically offset by a distance as indicated by the dimension O. The slot-excited vertical oriented L-shaped monopoles illustrated in FIG. 2 radiate vertically polarized waves, whereas the horizontally oriented L-shaped monopoles of FIG. 1 radiate horizontally polarized waves. The shapes of the wave patterns may be varied by changing the dimensions D, L, H and O.

As discussed in my IEEE article, supra, a variety of azimuthal horizontally polarized and vertically polarized patterns may be achieved with the slot-excited L-shaped monopoles described herein with reference to FIGS. 1 and 2. Whereas a variety of such patterns have been achieved, there has been no teaching of splitting the magnitudes of the vertically polarized radiation and the horizontally polarized radiation. Certainly, there has been no indication that the vertically polarized component can be reduced without affecting pattern control. Moreover, such prior art has not provided a teaching that the shape of the vertically polarized pattern may be controlled independently of that of the horizontally polarized energy. These features discussed are the subject of the improvements of the present invention to be described hereinafter with reference to the embodiments disclosed in FIGS. 3–8 and with reference to the waveforms of FIGS. 9–14.

Figure 3A:
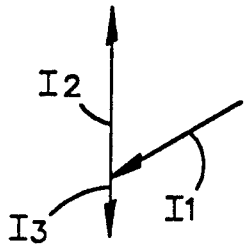
FIGS. 3A and 3B are graphical illustrations showing current flow in the monopoles of FIG. 3.
Figure 3:
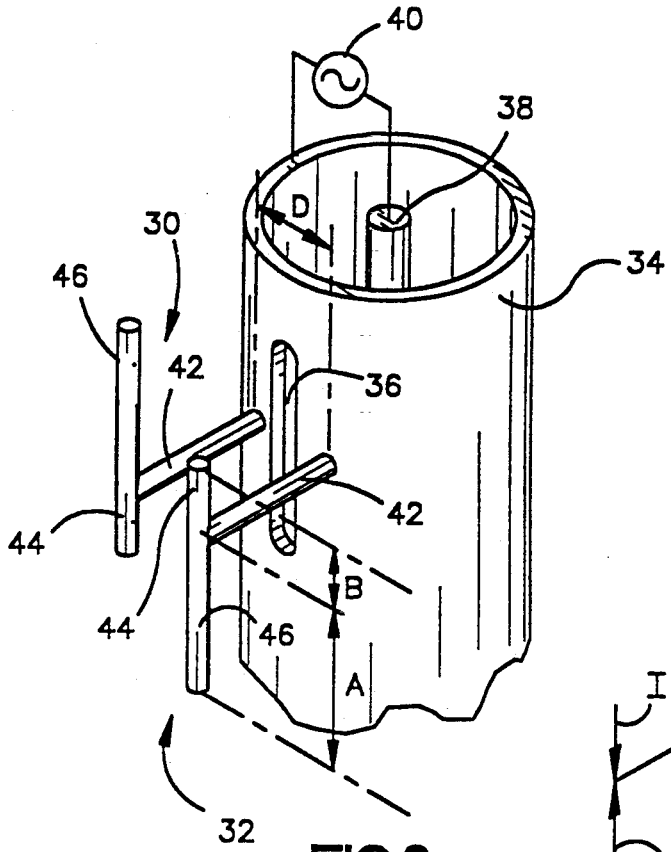
FIG. 3 is a perspective view of an antenna system in accordance with one embodiment of the present invention employing a pair of tau-shaped vertically aligned monopoles straddling a slot in a cylindrical mast.

The antenna system in accordance with the present invention, as shown in the embodiment of FIG. 3, includes a pair of tau-shaped monopoles 30 and 32 mounted on a stainless steel cylindrical mast 34 having at least one elongated slot 36. The slot 36 extends in a vertical direction and has a length on the order of one wavelength at the operating frequency of the antenna system. The mast 34 may take the form of a coaxial waveguide having an inner conductor 38 with the RF energy to be radiated being supplied by a source 40 interconnected between the inner conductor 38 and the mast 34. It is to be appreciated that other waveguide configurations such as circular or rectangular may also be employed.

Each of the monopoles is comprised of conductive arms, such as brass. In a manner similar to that of the L-shaped monopoles of the prior art in FIGS. 1 and 2, the tau-shaped monopoles 30 and 32 each include a connecting arm 42 which extends radially outward from the cylindrical mast 34 from a point along one side of the slot 36 and at a location approximately midway along the length of the slot. This connecting arm 42 is in the horizontal plane as viewed in FIG. 3 and terminates at vertically oriented arms 44 and 46. In this embodiment, arm 46 is longer than the arm 44. This provides the basis for the term "tau-shaped" monopole. The longer arm 46 of monopole 30 extends vertically upward, whereas the arm 46 of monopole 32 extends vertically downward.

Figure 3B:
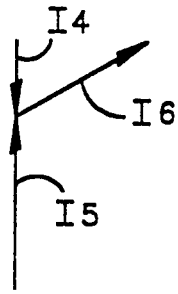

The coupling between the slot 36 and the monopoles 30 and 32 is accomplished by way of the radiated E near field generated from the slot. This field induces corresponding oppositely flowing currents in the radially extending arms 42. Thus, as shown by the arrows in FIG. 3A, the current $I_1$ flowing in arm 42 flows radially outward from the mast to the juncture at which the current is split and flows as current $I_2$ and $I_3$ in opposing directions in arms 46 and 44, respectively. The current flowing in the corresponding arms in monopole 32 flows in the opposite direction, as indicated by the arrows $I_4$, $I_5$, and $I_6$ in FIG. 3B. The currents $I_1$ and $I_6$ flowing in the radially extending arms 42 of monopoles 30 and 32 control the horizontally polarized E field radiation.

The current flowing in the vertically oriented arms of monopoles 30 and 32 controls the E field vertically polarized radiation. The amplitude of this radiation is controlled by the difference in length between the vertical arms. Thus, arm 44 is substantially shorter than that of arm 46. The magnitude of the current $I_3$ is substantially less than that of current $I_2$. The difference in length between vertical arms 44 and 46 results in the difference between currents $I_2$ and $I_3$.

Consequently, varying the length of the vertical arms 44 and 46 will control the magnitude of the radiated vertically polarized waveform. It has been determined that this control of the magnitude takes place without affecting the pattern of the radiated horizontally polarized waveform, as such waveforms are controlled by arms 42. Reference is now made to the embodiment illustrated in FIG. 4 which is quite similar to the embodiment of FIG. 3 and like components in both embodiments are described with the same character references. In this embodiment, monopoles 50 and 52 are shown as being mounted on a cylindrical mast 34 having an elongated vertically oriented slot 36 therein. The monopoles 50 and 52 each include a radially extending connecting arm 62 which terminates into a pair of vertically oriented arms 64 and 66. Arms 64 and 66 differ from those shown in FIG. 3 in that these arms are of equal length. Consequently, with arms 44 and 46 being of equal length, no vertically polarized radiation is generated, since the currents in the two arms will be equal and be directed in opposite directions. The current amplitude in the radially extending arms 62 can be controlled based on the length of these arms. The pattern radiated may take the form of a somewhat narrow horizontally polarized peanut-shaped pattern.

Figure 5:
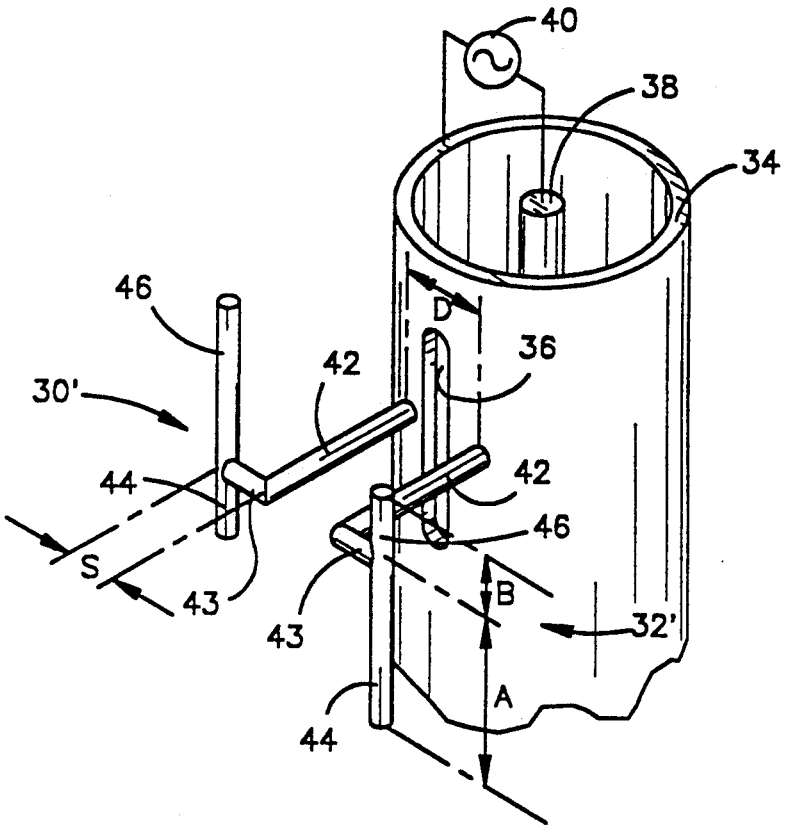
FIG. 5 is a perspective view similar to that of FIG. 3 but showing a third embodiment of the present invention wherein each tau-shaped monopole is provided with an intermediate extension portion.

Reference is now made to the embodiment shown in FIG. 5 which is quite similar to that of the embodiment shown in FIG. 3 and, consequently, like components are identified with like character references. In the embodiment of FIG. 5, monopoles 30' and 32' are mounted to a cylindrical mast 34 on opposite sides of a elongated vertically oriented slot 36 in the same manner as monopoles 30 and 32 are mounted on the mast 34 in FIG. 3. Monopoles 30' and 32' differ from monopoles 30 and 32 by the inclusion of an offset portion or elbow 43 which extends horizontally outward from the radial arm 42 and then terminates in the vertically oriented arms 44 and 46. This offset portion has a length as indicated by the dimension S. The elbows 43 are of a dimension S to thereby increase the distance between the vertical arms 44 and 46 of monopoles 30' and 32. This provides better azimuthal pattern tracking between the horizontally polarized waves and the vertically polarized waves. Thus, varying the length of the elbow 43 by changing the dimension S will cause variations in the vertically polarized pattern and this will take place independently of changes in the horizontally polarized pattern. More specifically, as the dimension S is increased in length, the vertically polarized azimuthal pattern becomes narrower and, conversely, as the dimension S is decreased, the vertically polarized azimuthal pattern becomes wider. These pattern changes take place independently of those of the horizontally polarized azimuthal pattern.

Moreover, variations in the dimension D in the embodiments of FIGS. 3–6 herein result in variations in the shape of the azimuthal horizontally polarized and vertically polarized patterns. These patterns become narrower as the dimension D is increased and become wider as the dimension D is decreased. Also, variations in the length of arms 42, see the dimension H, also results in variations in the azimuthal horizontal and vertically polarized patterns. These patterns become wider when the dimension H is decreased and become narrower when the dimension H is increased.

Figure 4:
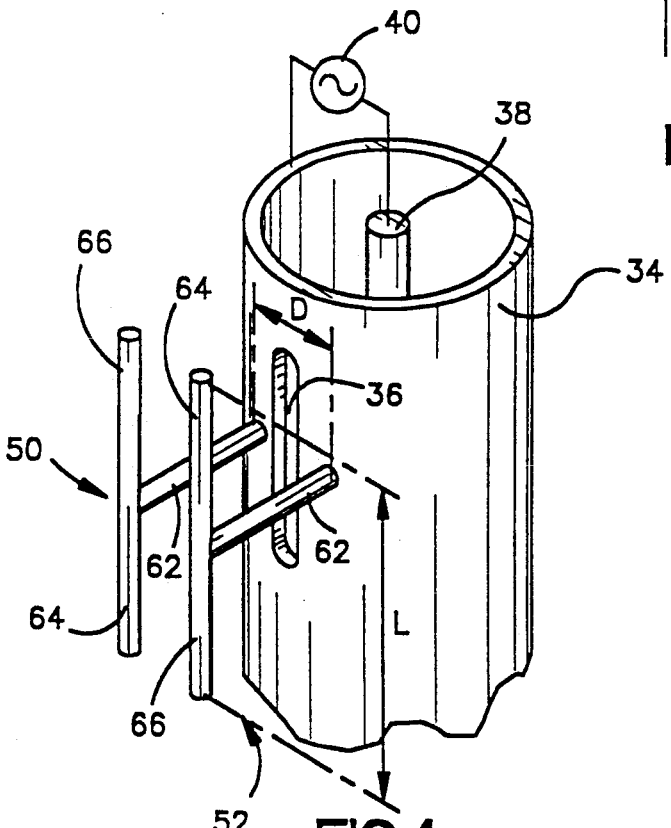
FIG. 4 is a second embodiment of the invention herein which illustrates a special case wherein each monopole has vertical arms of the same length.
Figure 6:
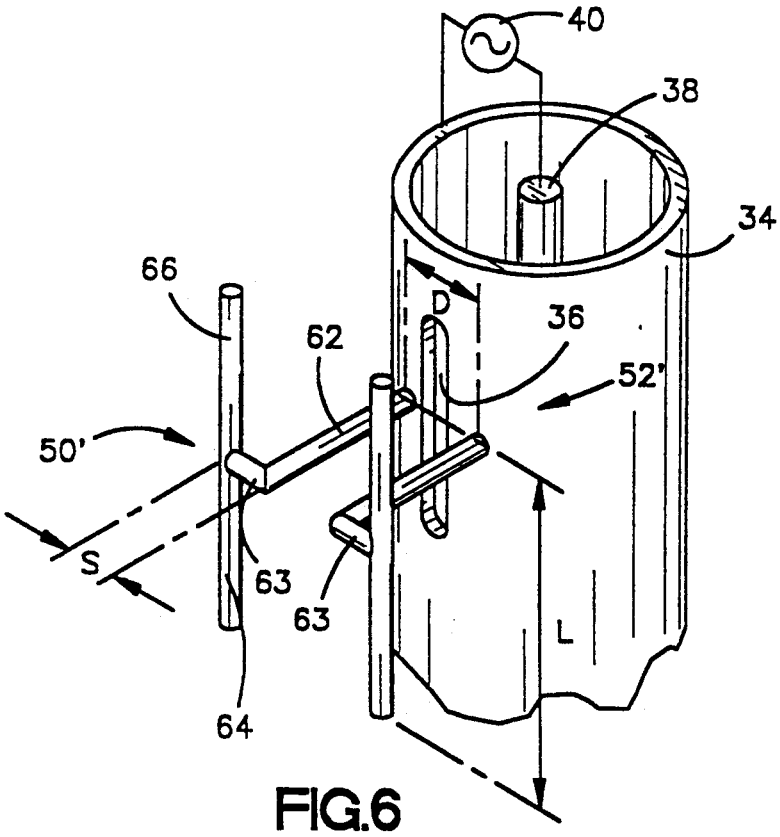
FIG. 6 is a perspective view similar to that of FIG. 5 but illustrating a fourth embodiment of the invention and wherein each tau-shaped monopole has vertical arms of the same length.

The embodiment of the invention as illustrated in FIG. 6 is similar to that of the embodiment illustrated in FIG. 4 and like components in both Figures will be identified with like character references. In the embodiment of FIG. 6, monopoles 50' and 52' each include a radially extending arm 62 as well as vertically extending arms 64 and 66 arranged in the same manner as the corresponding arms in FIG. 4. However, in the embodiment of FIG. 6 there is additionally provided an offset portion or elbow 63 which extends in the horizontal direction from arm 62 and is located intermediate arm 62 and the vertically oriented arms 64 and 66, as is shown in FIG. 6. Each of these elbows 63 is of a length in accordance with dimension S and serves the same purpose as that as described with respect to elbows 43 in the embodiment described hereinbefore with reference to FIG. 5. The embodiments of FIGS. 4 and 6 have equal length arms 64 and 66 and, consequently, these are special cases of the tau-shaped monopoles of FIGS. 3 and 5 and therefore may be considered as "T"-shaped monopoles since both vertically oriented arms are of equal length. Since the arms 64 and 66 are of equal length no vertically polarized radiation is generated. The current amplitude in each radially extending arm 62 may be controlled by varying the length of the arms as discussed hereinbefore. The embodiment as illustrated in FIG. 6 has been found to provide the narrow horizontally polarized peanut-shaped pattern.

Figure 7:
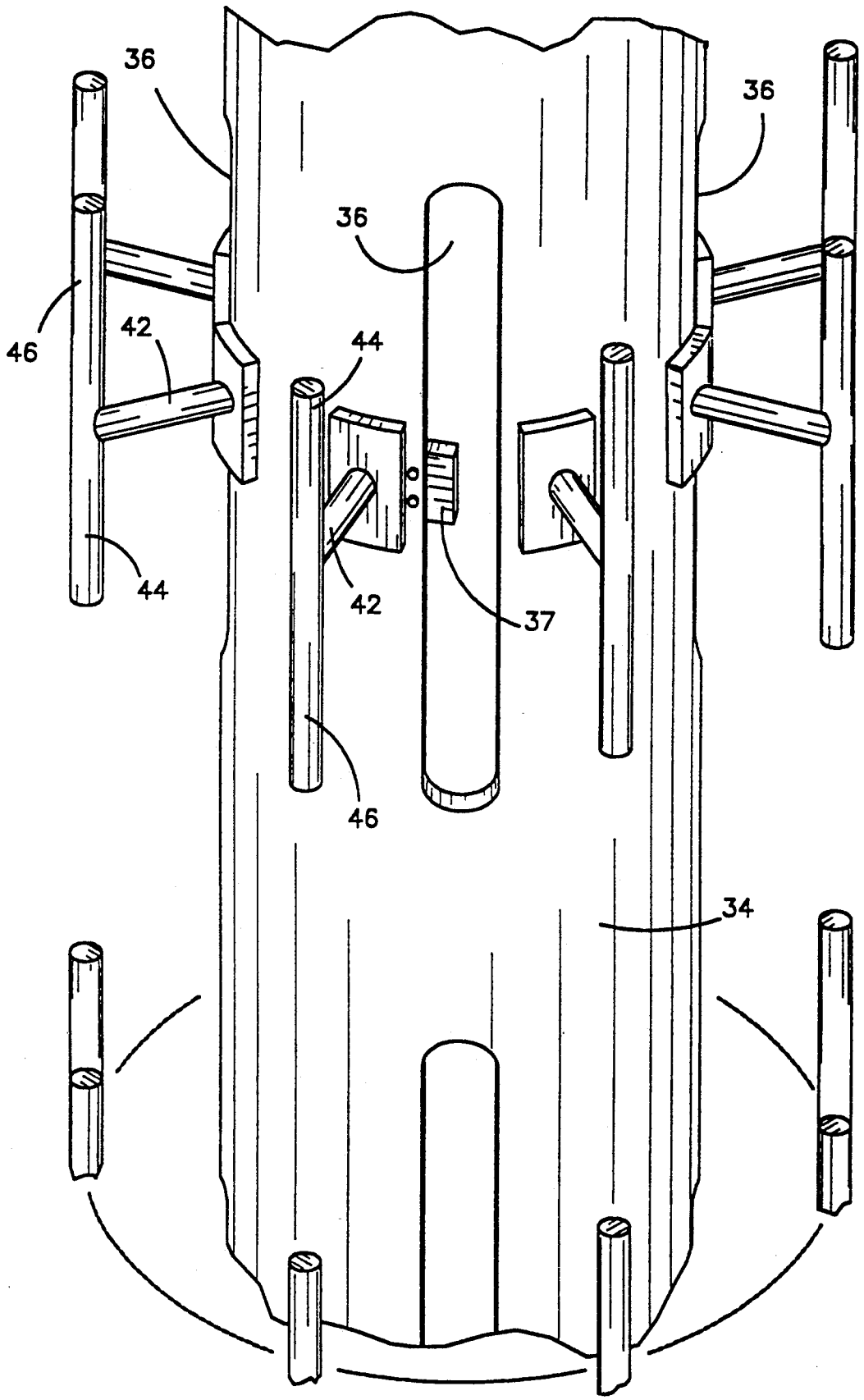
FIG. 7 is a perspective view illustrating an embodiment of the invention employing an annular array of slots in a cylindrical mast with each slot having associated therewith a pair of vertically aligned tau-shaped monopoles.

Reference is now made to FIG. 7 which illustrates an embodiment of the invention based on that illustrated in FIG. 3 and, consequently, like components are identified with like character references. This embodiment employs a mast 34 having vertically spaced apart annular arrays of vertically oriented slots 36. Each annular array includes four vertically oriented slots which are equally spaced from each other so that the spacing between slots is on the order of 90°. As is conventional, each slot has associated therewith a coupling probe 37 which is suitably mounted to one side of the slot at essentially the midpoint with respect to the longitudinal length of the slot and is located on the interior side of the mast. Although the coupling probe is illustrated as having a rectangular cross section, it may also have a circular cross section. It can be constructed of metal such as stainless steel. As discussed in U.S. patent to S. J. Bazan U.S. Pat. No. 2,981,947, such a coupling probe assists in coupling the energy within the mast so that a radiating field appears across each slot at which a coupling probe is associated.

Figure 8:
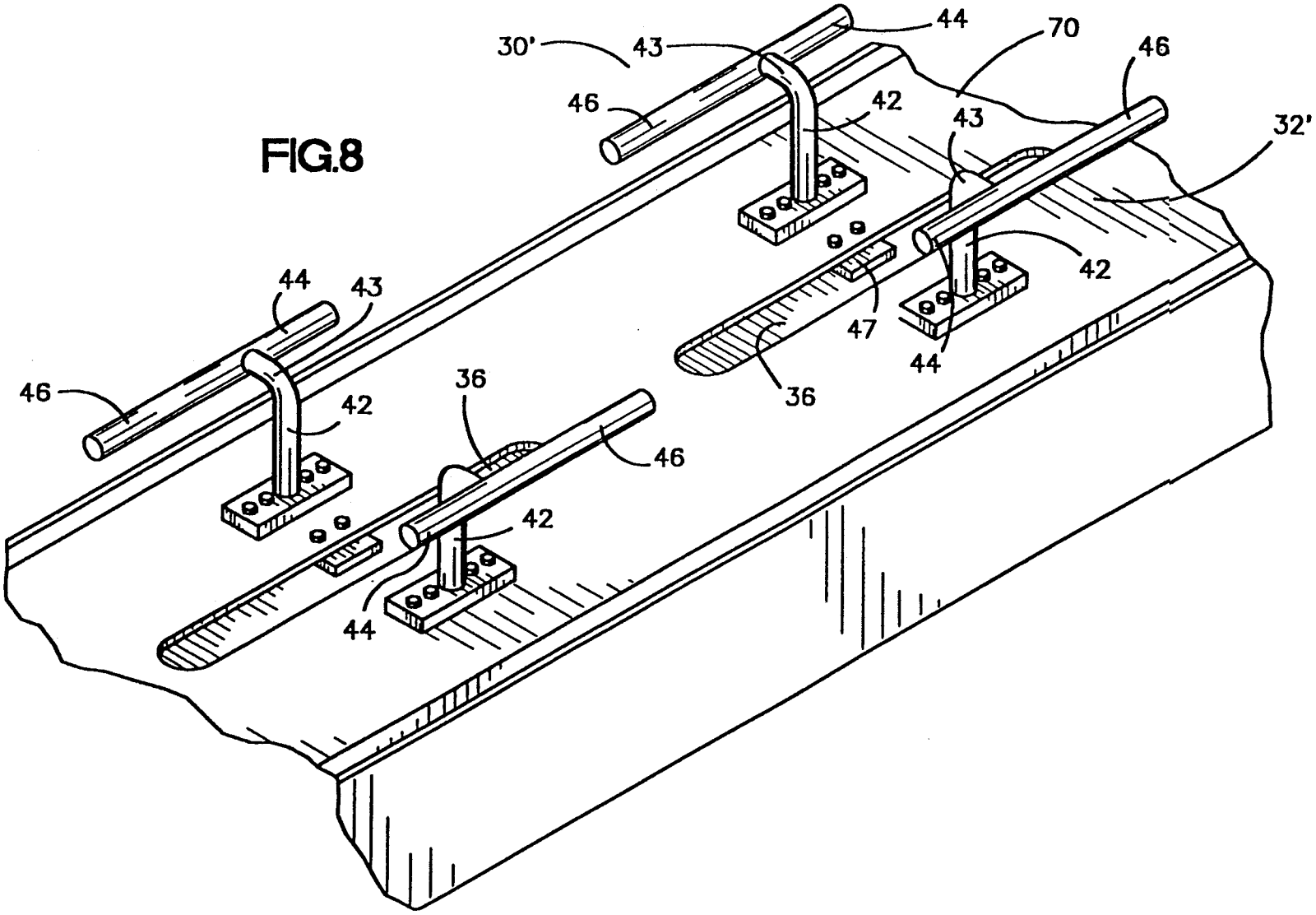
FIG. 8 is a perspective view illustrating another embodiment of the invention employing a plurality of elongated slots in one face of a rectangular waveguide and wherein each slot has associated therewith a pair of vertically aligned tau-shaped monopoles each having intermediate extension portions such as that illustrated in FIG. 5.

Attention is now directed to FIG. 8 which illustrates another embodiment of the invention in the form of a portion of the length of the rectangular waveguide slot antenna 70 having an array of vertically oriented slots 36 located in one face of the rectangular structure. Other than the rectangular shape of the waveguide, this embodiment is based on that shown in FIG. 5 in that each slot has associated therewith a pair of tau-shaped monopoles 30' and 32' each having a radial arm 42, an offset portion or elbow 43 and a pair of vertically oriented arms 44 and 46 with arm 44 being shorter than that of arm 46. Additionally, each slot is provided with a coupling probe 47 which is located within the mast and mounted to a side wall thereof so that it protrudes into the opening defined by the slot 36 at a location near the midpoint in the longitudinal direction of the slot. The arms 42 may be mounted directly to the face of the rectangular waveguide structure or, for example, may be mounted to a plate which is, in turn, bolted to the waveguide structure, as shown in FIG. 8.

Figure 9:
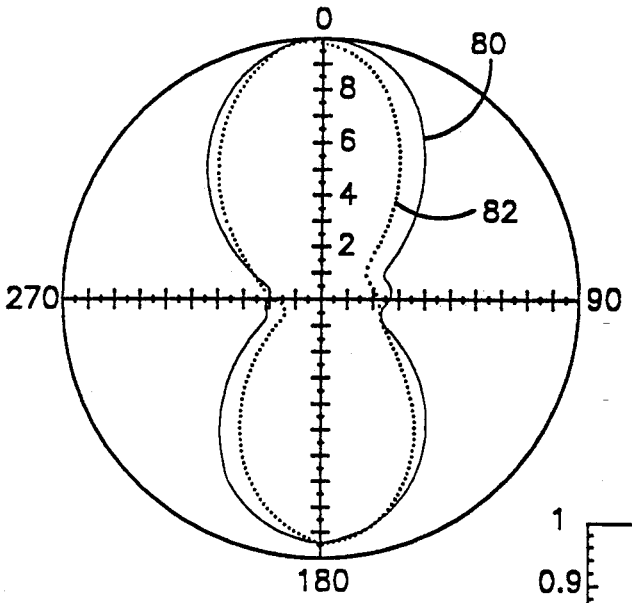
FIG. 9 illustrates measured horizontal and vertical polarized azimuthal patterns for one embodiment of the present invention.
Figure 10:
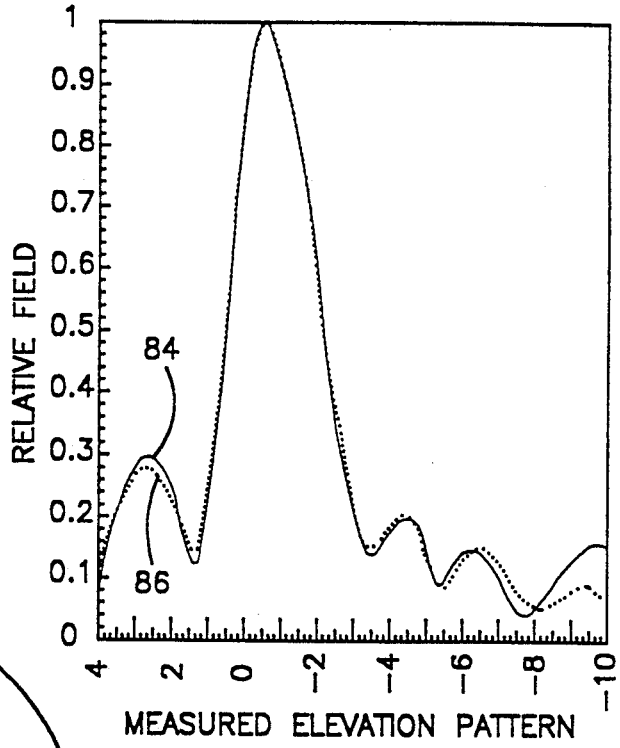
FIG. 10 shows measured radiation patterns of horizontally and vertically polarized waves in accordance with the same embodiment of the invention as that for FIG. 9.

An embodiment of the invention taking the form of a coaxial slot antenna array was constructed with the antenna including twenty-five bays with two vertically oriented slots per bay. The two slots are located 180° apart and each slot has associated therewith a pair of tau-shaped monopoles such that each slot together with a pair of associated monopoles takes the form as shown in FIG. 3. This antenna has been tested and it provided a full circular polarized peanut pattern at channel 53 operating at a frequency of 705.25 MHz at a wavelength on the order of 16.74 inches. Moreover, in this embodiment each radially extending arm 42 has a dimension on the order of 5.34 inches (0.319 wavelengths). The longer arm 46 has a dimension on the order of 6.35 inches (0.379 wavelengths) and the shorter vertical arm 44 has a length on the order of 1.75 inches (0.105 wavelengths). This antenna system does not include the horizontal offset or elbow 43 as shown in FIG. 5. The antenna was tested and the corresponding azimuth and elevation patterns for the horizontally and vertically polarized waves are respectively shown in FIGS. 9 and 10. Thus, FIG. 9 shows in solid lines the measured horizontally polarized peanut pattern 80 and in dotted lines the vertically polarized peanut pattern 82. The measured elevation pattern in FIG. 9 shows in solid lines the horizontally polarized pattern 84 and in dotted lines the vertically polarized pattern 86. These waveforms show good pattern tracking has been achieved in both the E and H planes, especially in the mainlobe beam width. The input impedance of the antenna is within 1.06 VSWR across the channel.

Figure 11:
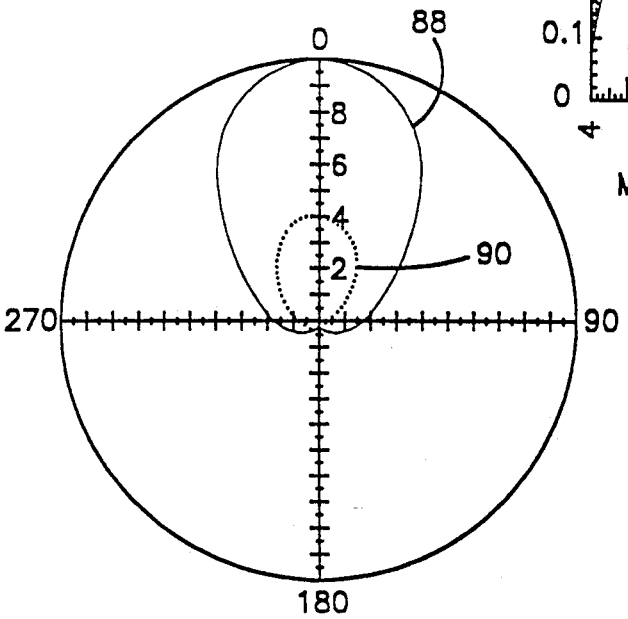
FIG. 11 illustrates measured horizontal and vertical polarized azimuthal patterns for a second embodiment of the present invention.
Figure 12:
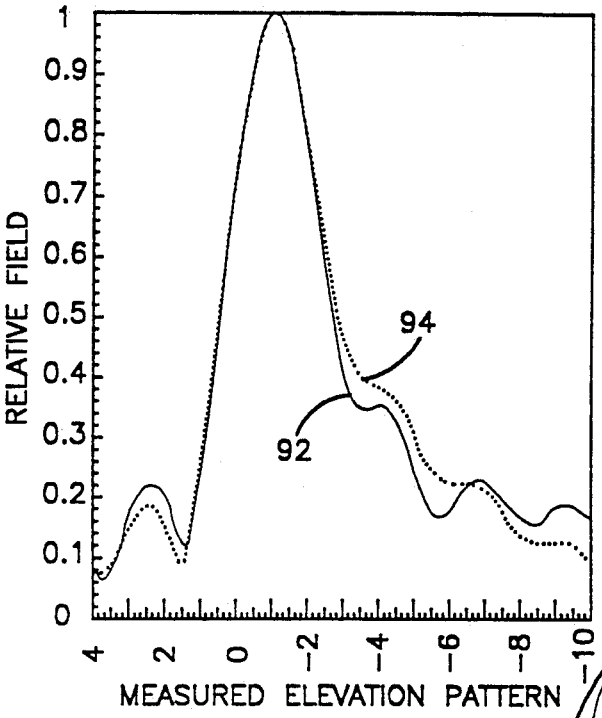
FIG. 12 shows measured radiation patterns of horizontally and vertically polarized waves in accordance with the same embodiment of the invention as that for FIG. 11.

A rectangular waveguide slot antenna based on that illustrated in FIG. 8 has been constructed and tested. This antenna operates at channel 50 at a frequency on the order of 689.25 MHz with a wavelength on the order of 17.12 inches. The antenna has twenty-five bays with one vertically oriented slot per bay and serves to generate an elliptically polarized narrow cardioid pattern with the corresponding azimuth and elevation patterns appearing as shown in FIGS. 11 and 12. In this embodiment, the dimension of the shorter arm 44 is on the order of 2.35 inches (0.137 wavelengths), whereas the dimension of the longer arm 46 is on the order of 5.07 inches (0.296 wavelengths). The length of each arm 42 is on the order of 3.50 inches (0.204 wavelengths), whereas the elbow or offset section 43 has a dimension on the order of 0.90 inches (0.053 wavelengths). An embodiment of the invention constructed as described has been tested and the measured azimuth and elevation patterns respectively are as shown in FIGS. 11 and 12. Thus, in FIG. 11, the solid line 88 shows the horizontally polarized wave and the dotted line 90 shows the vertically polarized wave and which has a magnitude on the order of 40% of that of the horizontally polarized pattern. The measured elevation patterns appear in FIG. 12 from which it is seen that the solid line 92 represents the horizontally polarized pattern, whereas the dotted line 94 represents the vertically polarized pattern. It is seen that good axial ratio has been obtained. Moreover, measurements have determined that a VSWR of less than 1.06 across the channel has been obtained.

Figure 13:
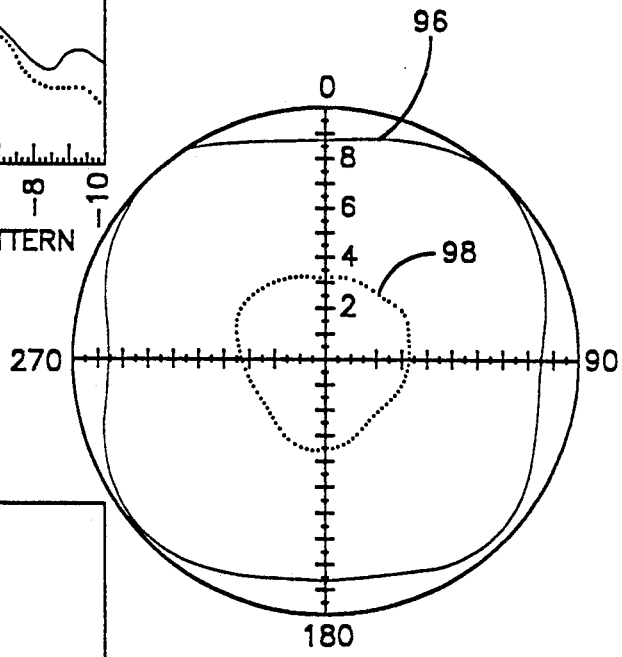
FIG. 13 illustrates measured horizontal and vertical polarized azimuthal patterns for a third embodiment of the present invention.
Figure 14:
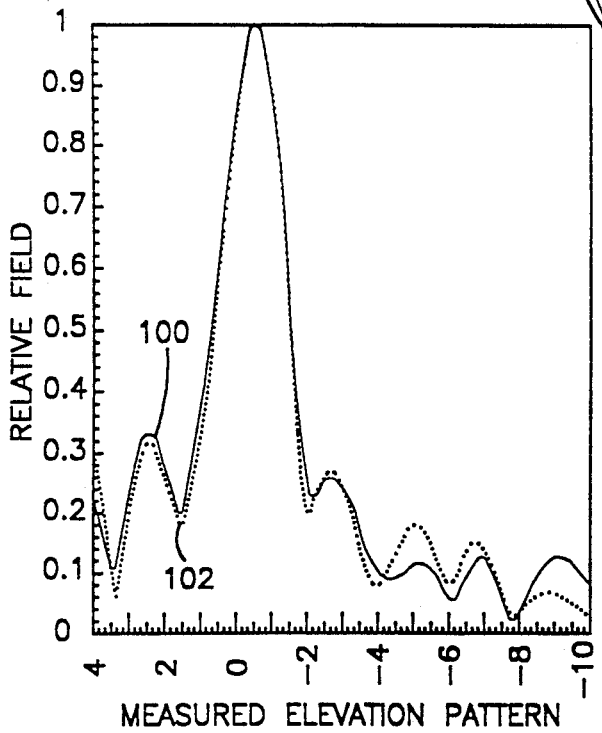
FIG. 14 shows measured radiation patterns of horizontally and vertically polarized waves in accordance with the same embodiment of the invention as that for FIG. 13.

An omni-directional coaxial slot antenna system based on that shown in FIG. 7 has been constructed. The antenna has thirty levels with each level having an annular array of four vertically oriented slots, as shown in FIG. 7. The antenna operates at channel 35 with a frequency on the order of 597.25 MHz at a wavelength of 19.76 inches. In this embodiment, each short arm 44 has a dimension on the order of 3.90 inches (0.197 wavelengths), whereas each longer vertical arm 46 has a dimension on the order of 4.88 inches (0.247 wavelengths). Each arm 42 has a length on the order of 2.75 inches (0.139 wavelengths), and no offset or elbow section is provided. In the tested embodiment it was found that the power split was 92.4% for the horizontally polarized wave and 7.6% for the vertically polarized wave. The vertically polarized azimuth pattern was more directional than that of the horizontally polarized pattern. The relative field azimuth pattern is shown in FIG. 13 from which it is seen that the horizontally polarized pattern is shown by the solid line 96, whereas the vertically polarized pattern is shown by the dotted line 98. The measured elevation patterns are shown in FIG. 14 from which it is noted that the solid line 100 represents the horizontally polarized pattern, whereas the dotted line 102 represents the vertically polarized pattern. Good axial ratio is maintained in the elevation plane as is noted from the patterns in FIG. 14. Moreover, in the tested antenna, a VSWR of less than 1.06 across the channel has been obtained.

Although the invention has been described in conjunction with preferred embodiments, it is to be appreciated that various modifications may be made without departing from the spirit and scope of the invention as defined by the appended claims.

Having described the invention, the following is claimed:

1. An elliptically polarized antenna comprising:

a conductive mast having at least one elongated slot extending longitudinally of said mast at the outer periphery thereof;

means for feeding said slot for exciting horizontally polarized waves; and first and second conductive elements respectively located on opposing sides of said slot for exciting vertically polarized waves, each of said elements having a connecting end portion extending transversely from and connected to said mast near one elongated side of said slot and having first and second free end portions extending therefrom in substantially opposing directions and substantially parallel to said slot, and wherein said first and second free end portions of each said element are of different lengths relative to each other for controlling the split of the magnitude of the radiated energy between said horizontally and vertically polarized waves and wherein said different lengths of said first and second free end portions determines the magnitude of said vertically polarized waves.

2. An antenna as set forth in claim 1 wherein said mast is an elongated hollow member having a rectangular cross section.

3. An antenna as set forth in claim 1 wherein said mast is an elongated hollow member having a cylindrical cross section.

4. An antenna as set forth in claim 1 including an intermediate arm interposed between said connecting end portion and said first and second free end portions with said intermediate arms having lengths chosen for controlling the width of the vertically polarized azimuthal pattern.

5. An antenna as set forth in claim 4 wherein said intermediate arms on said first and second elements extend in opposing directions to thereby increase the distance between the first and second end portions of said first element and said first and second free end portions of said second element to thereby control the width of the vertically polarized azimuthal pattern.

6. An antenna as set forth in claim 5 wherein for each of said first and second elements the said connecting end portion and the intermediate arm lie in a horizontal plane.

7. An antenna as set forth in claim 6 wherein said mast is an elongated hollow member having a circular cross section and wherein said mast is oriented in a vertical direction and has at least one annular array of slots including at least two vertically oriented slots each having associated therewith a said first and second conductive element.

8. An antenna as set forth in claim 7 including a plurality of said arrays of slots spaced vertically from each other.

9. An antenna as set forth in claim 6 wherein said mast is an elongated hollow member having a rectangular cross section and including a plurality of slots oriented in a vertical direction with each of said slots having associated therewith a said first and second conductive element.

* * * * *